US007470115B2

(12) United States Patent
Meacham et al.

(10) Patent No.: US 7,470,115 B2
(45) Date of Patent: Dec. 30, 2008

(54) OUTER DIAMETER NUT PILOTING FOR IMPROVED ROTOR BALANCE

(75) Inventors: Walter L. Meacham, Phoenix, AZ (US); Albert G. Selder, Gilbert, AZ (US)

(73) Assignee: Honeywell International Inc., Morristown, NJ (US)

( * ) Notice: Subject to any disclaimer, the term of this patent is extended or adjusted under 35 U.S.C. 154(b) by 376 days.

(21) Appl. No.: 11/176,537

(22) Filed: Jul. 6, 2005

(65) Prior Publication Data

US 2006/0013693 A1 Jan. 19, 2006

Related U.S. Application Data

(60) Provisional application No. 60/587,913, filed on Jul. 13, 2004.

(51) Int. Cl.
*F04D 29/00* (2006.01)
*F03B 11/04* (2006.01)

(52) U.S. Cl. ..... 416/244 R; 416/204 A; 416/244 A

(58) Field of Classification Search ..... 416/244 R, 416/244 A, 244 B, 223 B, 204 R, 204 A
See application file for complete search history.

(56) References Cited

U.S. PATENT DOCUMENTS

| | | | | |
|---|---|---|---|---|
| 1,974,746 | A | 9/1934 | Kuhnen | |
| 2,161,740 | A | 6/1939 | Eksergian | |
| 2,320,030 | A | 5/1943 | Danforth | |
| 4,169,630 | A | 10/1979 | Wagner | |
| 4,944,660 | A * | 7/1990 | Joco | 417/407 |
| 5,022,823 | A | 6/1991 | Edelmayer | |
| 5,533,863 | A | 7/1996 | Tornquist et al. | |
| 5,846,049 | A * | 12/1998 | DuPuis | 415/131 |
| 6,307,278 | B1 | 10/2001 | Nims et al. | |
| 6,406,263 | B1 | 6/2002 | Meacham et al. | |
| 6,896,479 | B2 * | 5/2005 | Svihla et al. | 415/104 |
| 2003/0086782 | A1 * | 5/2003 | Moorehead et al. | 415/1 |

* cited by examiner

*Primary Examiner*—Edward Look
*Assistant Examiner*—Dwayne J White
(74) *Attorney, Agent, or Firm*—Ingrassia, Fisher & Lorenz, P.C.

(57) ABSTRACT

The present invention provides for outer diameter piloting of a nut that secures stacked components to a tie-shaft or other threaded components used to axially secure one or more rotating components. Unlike conventional inner diameter piloting methods, machining a precise inner diameter of the nut is not needed. The nut face of the present invention has superior perpendicularity with the tie-shaft and the radial pilot is not lost when the nut is loaded. Outer diameter nut piloting may be conducted by using a nut alone or a nut in combination with a nut spacer, a pocket in the rotor, a nut spacer seat, or a nut piloting insert.

22 Claims, 14 Drawing Sheets

OUTER DIAMETER NUT PILOTING FOR IMPROVED ROTOR BALANCE

CROSS-REFERENCE TO RELATED APPLICATIONS

This application claims the benefit of U.S. Provisional Patent Application No. 60/587,913, filed on Jul. 13, 2004.

BACKGROUND OF THE INVENTION

The present invention generally relates to rotating machinery, such as gas turbine engines, and more specifically, to piloting a nut used on a shaft to apply a compressive axial force to a plurality of stacked components to position the components and to position the nut on the shaft.

In rotating assemblies used in high speed machinery, the components are often clamped either by a tie-shaft and nut or by bolted flange joints. In many applications, nuts and bolts are used to apply compressive forces on multiple components, securing them in a stacked relationship. The compressive force through the components is equal to the tensile force in the bolt(s), which stretches proportionally to the bolt length. These nuts and bolts maintain the axial location of the components relative to each other and must also ensure that radial position is controlled.

Gas turbine engines include rotating components such as a fan, a compressor, a shaft, a seal and a turbine. A nut is often used on the end of a threaded shaft to secure and position engine components relative to the shaft. The shaft typically has a radial flange extending outward at one end to provide an abutting surface and threads for the nut at the opposite end. The engine components are stacked along the shaft such that the shaft extends through the center of the components. The nut is threaded to the shaft to apply a compressive force through the components that secures them in place relative to the shaft, and thus pilots the components.

Components in a rotating group require an axial facing pilot and a radially oriented pilot when mated to another component. Components that are located between two other components require an axial facing pilot and a radially oriented pilot at each interface. The threads of a nut and bolt (or tie-shaft) provide both an axial facing pilot and a radially oriented pilot at the nut to tie-shaft interface. However, at the nut to rotor stack interface, often only an axial pilot is provided.

The axial facing pilot and radially oriented pilot require geometric control such that these features are true to each other (perpendicular). Lack of perpendicularity of the axial facing pilot and radially oriented pilot results in shaft bow. It is easy to control the perpendicularity between the face and diameter of a component, however, it is difficult to have precision control between the threads of a nut and the face of the nut. This is also true of a bolt, tie-shaft, or other threaded component(s).

When a tie-shaft and nut are used, problems often occur, such as problems with balance repeatability and associated vibration effects due to a lack of piloting of the nut, or shifting of the nut relative to the rotor stack due to lack of radial piloting of the nut. Various conventional designs for the tie-shaft and nut have been proposed and used in gas turbine engines to maintain position control of the nut relative to the rotor stack.

One such conventional design is disclosed in U.S. Pat. No. 5,022,823 to Edelmayer ("Edelmayer patent"). FIG. 1 shows a prior art rotor attachment assembly 10 for securing a rotor 12, such as a compressor impeller, to a rotor shaft 14, generally according to the Edelmayer patent. The shaft 14comprises a smooth shaft body 24 and a threaded nut-receiving portion 26, which may have a smaller diameter than the shaft body 24. The nut 16 includes an unthreaded shaft locating hole 30 and a threaded hole 28. When the nut 16is fully threaded onto the shaft 14, a nut mating surface 20 of the rotor 12 and the rotor mating surface 32 of the nut 16 mate to create an axial load across the rotor 12 to axially secure the rotor 12 with the shaft 14. The unthreaded shaft-locating hole 30 provides a radial pilot of the nut 16 relative to the shaft body 24. This feature of the Edelmayer patent provides a positive radial pilot for the nut 16 to shaft 14.

Again with reference to the prior art assembly of FIG. 1, when the nut 16 is tightened onto the shaft 14 to press against the rotor 12, an axial load is left between the body 24 of the shaft 14 and the threaded hole 28 of the nut 16. Furthermore, as the nut 16 is tightened, the unthreaded shaft locating hole 30 may expand outwardly, reducing the fit between unthreaded shaft-locating hole 30 and the shaft body 24, allowing the nut 16 to move radially relative to the shaft 14. This may result in a loss of nut radial piloting to shaft 14 and an increase in rotor bow and unbalance. The Edelmayer design requires very close tolerances between the shaft 14 and the nut 16 to assure coaxiality of the shaft 14 and nut 16 to minimize shaft bending. The tolerances of Edelmayer are so close so as to preferably comprise an interference fit between the unthreaded shaft locating hole 30 and the body 24 of the shaft 14, which makes tightening of the nut 16 difficult. Unfortunately, obtaining and maintaining the close tolerances involved in the Edelmayer patent requires considerable labor and expense.

As can be seen, there is a need for an improved apparatus and method for maintaining group balance, including balance repeatability when a rotating group is secured with a nut and tie-shaft or like axial loading feature. Furthermore, there is a need for an improved apparatus and method that does not require extremely close tolerances or an interference fit of the nut to the shaft.

SUMMARY OF THE INVENTION

In one aspect of the present invention, a rotor assembly comprises a rotor, a shaft coaxial with the rotor, and a nut for axially loading the rotor and the shaft. The rotor includes a rotor axial facing surface and a rotor radially inward surface; the nut includes a nut axial facing surface and a radially outward surface. An axial load exists between the rotor axial facing surface and the nut axial facing surface, and radial piloting of the nut to the rotor occurs between the rotor radially inward surface and the nut radially outward surface.

In a further aspect of the present invention, a rotor assembly comprises a tie-shaft, a rotor disposed on the tie-shaft, a nut for axially loading the rotor and the tie-shaft, and a nut spacer disposed on at least one of the rotor and the tie-shaft.

In another aspect of the present invention, a rotating component stack for a turbine system comprises a rotor stack having a shaft receiving bore axially defined therein; a tie-shaft disposed within the shaft-receiving bore; and a nut for axially loading the rotor stack and the tie-shaft. The rotor stack comprises a plurality of components, each of the plurality of components and the nut having a common axis, and each of the plurality of components of the rotor stack and the nut being secured in fixed relation to each other. The nut has a nut mating surface and a nut axial facing surface. The nut is piloted on an outer diameter of the nut. The rotor stack includes a rotor radially inward surface and a rotor axial facing surface, and the rotor axial facing surface and the nut mating surface are perpendicular to the tie-shaft axis.

These and other features, aspects, and advantages of the present invention will become better understood with reference to the following drawings, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides an apparatus and method for radial piloting of the nut outer diameter of a rotating assembly, such as those used in gas turbine engines when an outer stack of rotating components is clamped by a tie-shaft and a nut. The present invention may also be applied to the broad sense of rotating assemblies, including, but not limited to motors, generators, magnetic bearings, industrial pumps, steam turbines, air cycle machines, turbo-chargers, and balance arbors.

By maintaining perpendicularity between the outer-diameter of the nut and the axial facing pilot of the nut, when the nut is secured on the tie-shaft, the nut outer diameter increases in diameter, providing a radial pilot with the mating component. Thus, unlike conventional designs for fastening a rotor to a rotor shaft, the shaft in the present invention is less likely to bend because the present invention reduces non-uniform loading that may lead to non-parallelism of the assembled rotor and the nut mating surfaces. Piloting the nut on the outer diameter of the nut may be conducted with a nut alone, or with a nut in combination with a nut spacer, a pocket in the rotor (for example, wherein a rotor radially inward surface surrounds at least a portion of the nut), a nut spacer seat, which can serve other functions such as a rotating surface of a seal, or a nut piloting insert. By piloting the nut on the outer diameter of the nut, excessive deflective pressure can be avoided on the shaft. Piloting the nut on the outside enables reduction of group unbalance and enhancing repeatability of group balance between assemblies of the rotating group.

Outer diameter piloting (radial position control) may avoid the need for machining a very precise inner diameter of the nut, which can be costly. In inner diameter piloting, the nut grows away from the shaft when loaded, loosing the radial pilot, which can result in increased rotor unbalance due to bowing of the rotor and lack of balance repeatability. Outer diameter piloting avoids this problem since the nut outer diameter will increase when loaded, tightening the radial pilot.

Figure 1:
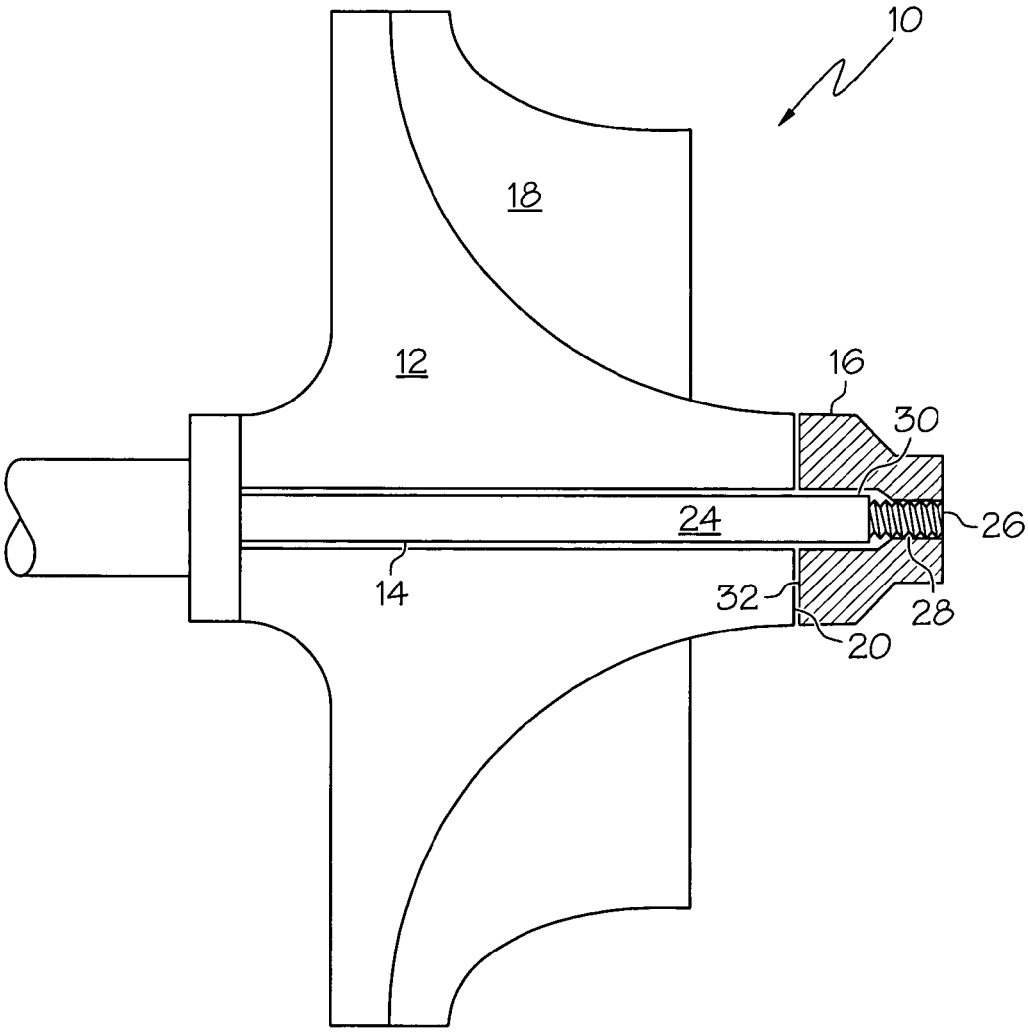
FIG. 1 (PRIOR ART)
FIG. 1 is an axial sectional view of a rotor assembly, according to the prior art.
Figure 2B:
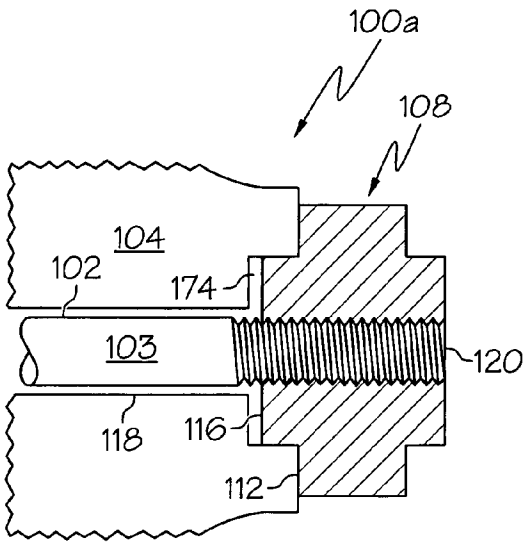
FIG. 2B is an axial sectional view of the rotor assembly of FIG. 2A.
Figure 2A:
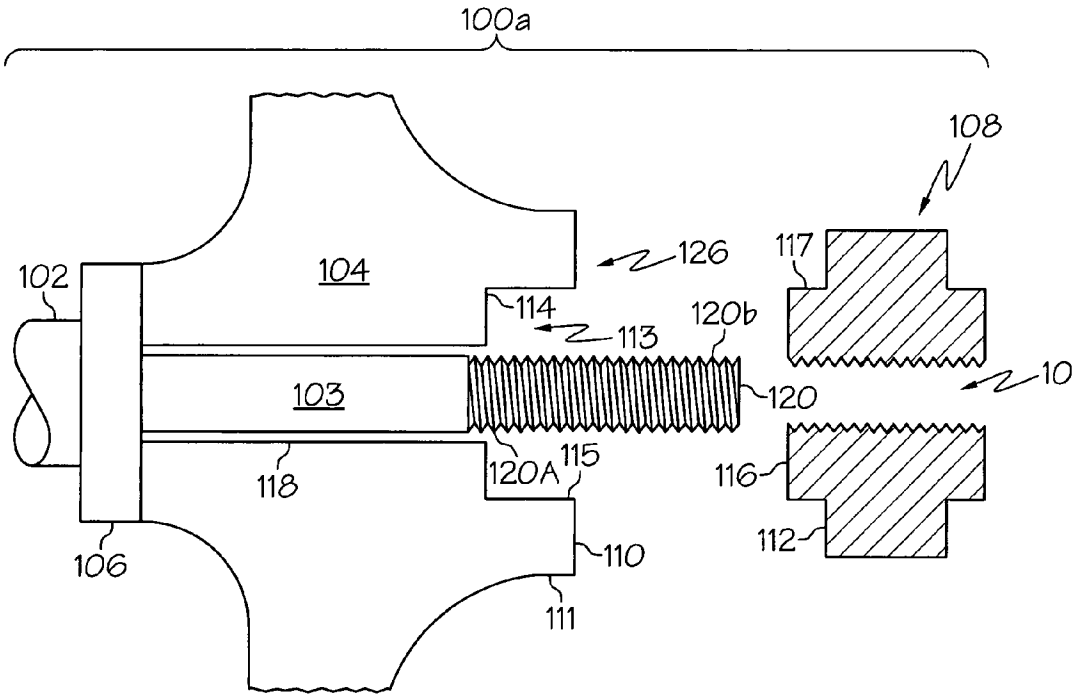
FIG. 2A is an exploded axial sectional view of a rotor assembly, according to an embodiment of the present invention.

FIG. 2A is an exploded sectional view of a rotor assembly 100*a*, according to the present invention. Rotor assembly 100*a* may comprise a rotor 104, which may have a shaft-receiving bore 118 axially defined therein, and a shaft 102 disposed within shaft-receiving bore 118. Shaft 102 may be coaxial with rotor 104. Shaft 102 may include a flange 106 and a smooth body portion 103. Shaft 102 may comprise a tie-shaft. Rotor assembly 100*a* may further comprise a nut 108 for axial loading of rotor 104 and shaft 102. Shaft 102 may further include a threaded portion 120 for receiving nut 108. Rotor 104 may be axially loaded against flange 106 via nut 108 mounted on shaft 102.

FIG. 2B is a sectional view of rotor assembly 100*a* of FIG. 2A showing nut 108 mounted on shaft threaded portion 120. Shaft threaded portion 120 may have a diameter less than a diameter of smooth body portion 103. In some embodiments of the present invention, a plurality of rotors 104 may be stacked on shaft 102 to form a component stack (see, for example, FIG. 11), and the plurality of rotors 104 may be axially loaded by a single nut 108 or by a plurality of axially separated nuts 108. Rotor(s) 104 may be co-axial with shaft 102.

With reference to FIGS. 2A-B, rotor 104 may have an inner rotor axial facing surface 114 and an outer rotor axial mating surface 110. Nut 108 may have an outer nut axial mating surface 112 and an inner nut axial facing surface 116. When nut 108 is fully threaded onto shaft threaded portion 120, an axial load may be created in shaft 102, and rotor axial mating surface 110 may mate with nut axial mating surface 112 to transfer the applied axial load to rotor 104. Rotor axial mating surface 110 and nut axial mating surface 112 may each be perpendicular to shaft receiving bore 118. An axial gap 174 may exist between rotor axial facing surface 114 and nut axial facing surface 116.

With further reference to FIGS. 2A-B, rotor 104 may further comprise a nut-receiving portion 126. Nut-receiving portion 126 may comprise an axial extension of rotor 104, and may surround at least a distal end 120*a* of shaft threaded portion 120. Nut-receiving portion 126 may define an annular recess 113 within rotor 104, wherein annular recess 113 may be bounded by rotor axial facing surface 114 and a rotor radially inward surface 115. Annular recess 113 may provide a void for receiving at least a portion of nut 108. A proximal end 120*b* of shaft threaded portion 120 may extend axially beyond rotor axial mating surface 110. Rotor radially inward surface 115 may be perpendicular to rotor axial mating surface 110. Rotor radially inward surface 115 and nut radially outward surface 117 may each be parallel to shaft-receiving bore 118. Nut-receiving portion 126 may have a nut-receiving portion outer surface 111.

Nut 108 may further comprise a nut radially outward surface 117, which may define a portion of the outer-diameter of nut 108. Nut radially outward surface 117 may be perpendicular to nut axial mating surface 112. Rotor radially inward surface 115 and nut radially outward surface 117 may each be parallel to shaft-receiving bore 118.

When nut 108 is loaded by shaft 102, rotor radially inward surface 115 may be in close proximity to, or in contact with, nut radially outward surface 117, resulting in nut radially outward surface 117 of nut 108 being radially piloted by an inner diameter of rotor 104, namely rotor radially inward surface 115.

Nut 108 may comprise a steel alloy such as 4340 steel or A286 steel, a nickel-base superalloy, such as, Inco 718™, a cobalt-base superalloy, a titanium alloy, an aluminum alloy, or other suitable material.

Embodiments of the present invention shown in FIGS. 3A-10B may have elements and features as described with reference to FIGS. 2A-B, including shaft 102 and flange 106. Only the nut end portion of the rotor assembly is shown in FIGS. 3A-10B for the sake of clarity. As can be seen, for example, in FIGS. 3A-D and 4A-B, other embodiments of a rotor assembly according to the present invention may also include a rotor 104 having a nut-receiving portion 126 for receiving and at least partially surrounding a nut 108.

Figure 3B:
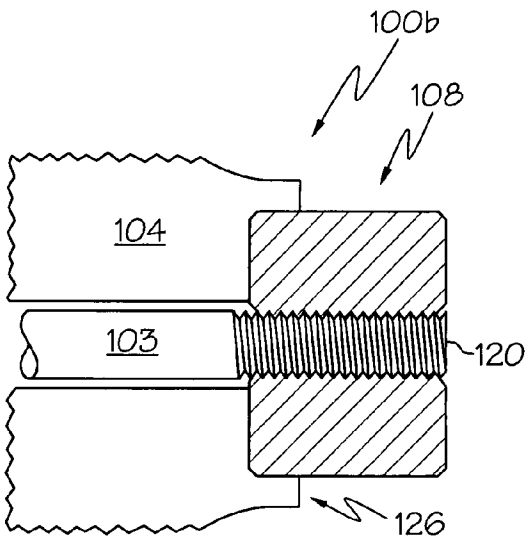
FIG. 3B is an axial sectional view of the rotor assembly of FIG. 3A.
Figure 3A:
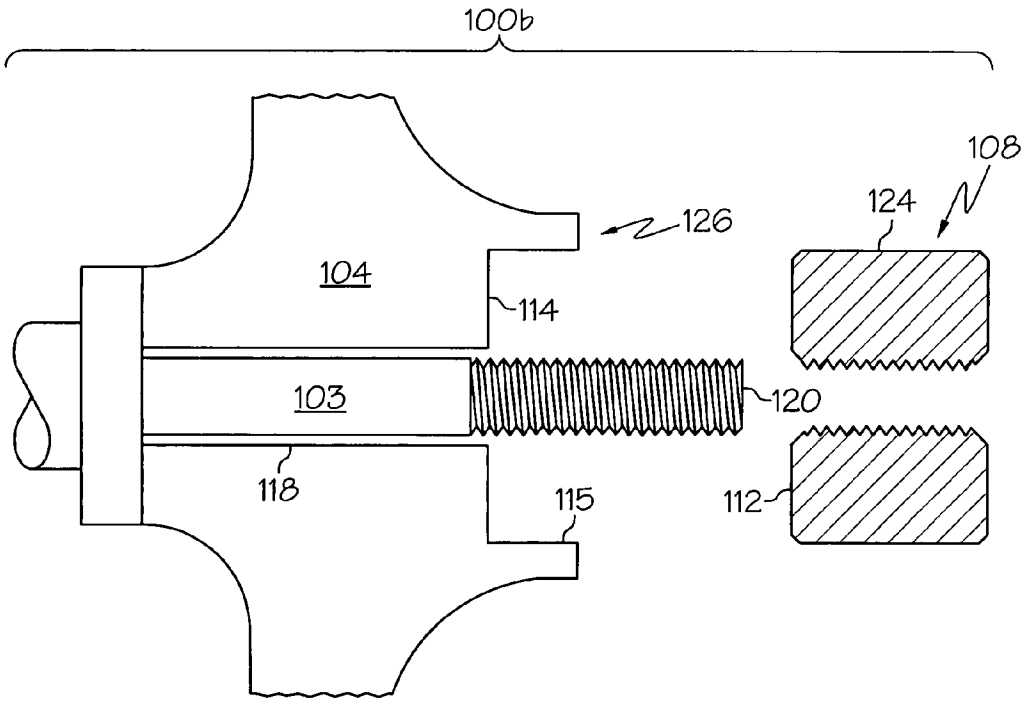
FIG. 3A is an exploded axial sectional view of a rotor assembly, according to another embodiment of the present invention.

FIG. 3A is an exploded sectional view of a nut end of a rotor assembly 100*b*, and FIG. 3B is a sectional view of rotor assembly 100*b* showing nut 108 mounted on shaft 102, according to an embodiment of the present invention. With reference to FIGS. 3A-B, rotor assembly 100*b* may comprise a nut-receiving portion 126, which may surround a distal portion of nut outer diameter 124 of nut 108. Nut axial facing surface 112 may make axial contact with, and may transfer an axial load to, rotor axial facing surface 114. Nut outer diameter 124 may mate with rotor radially inward surface 115 of nut receiving portion 126.

Figure 3D:
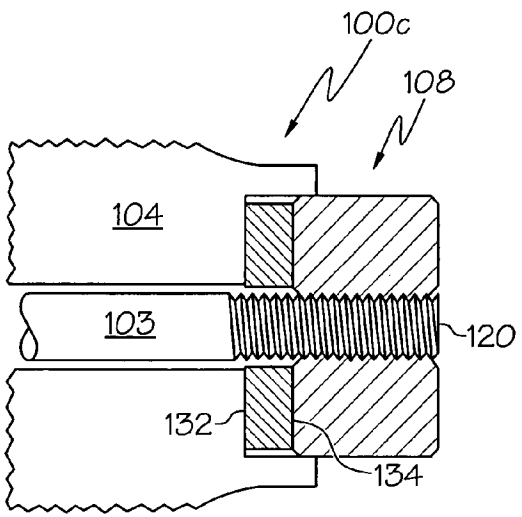
FIG. 3D is an axial sectional view of the rotor assembly of FIG. 3C.
Figure 3C:
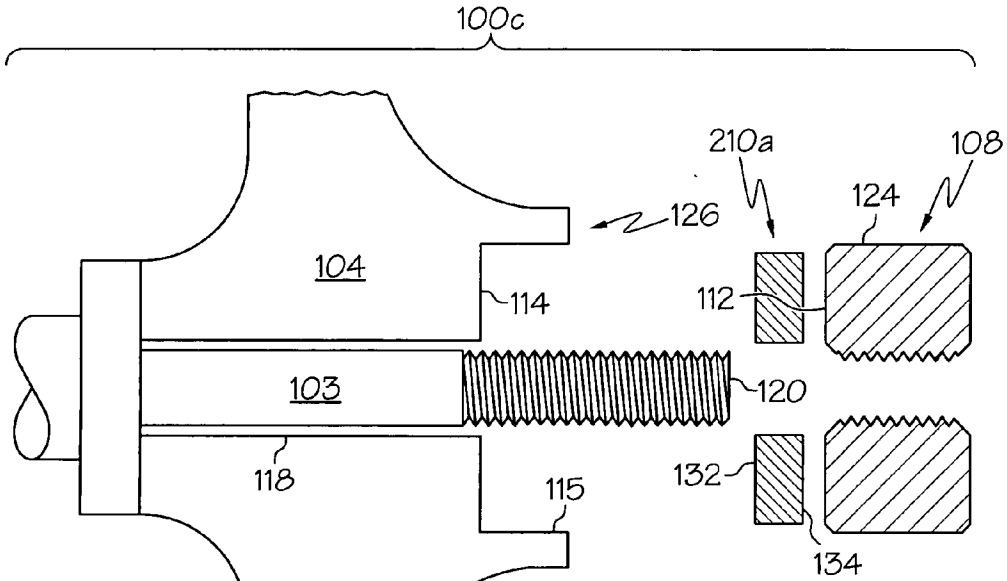
FIG. 3C is an exploded axial sectional view of a rotor assembly, according to another embodiment of the present invention.

FIG. 3C is an exploded sectional view of a nut end of a rotor assembly 100*c* having a nut spacer 210*a*, and FIG. 3D is a sectional view showing nut spacer 210*a* and nut 108 mounted on shaft 102, according to another embodiment of the present invention. The embodiment shown in FIGS. 3C-D may further include those elements and features described hereinabove with reference to FIGS. 3A-B.

With reference to FIGS. 3C-D, nut spacer 210*a* may be disposed axially between rotor 104 and nut 108. Nut spacer 210*a* may be in the form of a plain washer, for example, a disc-shaped structure having a bore therethrough for accommodating shaft threaded portion 120. Nut spacer 210*a* may have a spacer first axial surface 132 and a spacer second axial surface 134. Spacer first axial surface 132 may mate with rotor axial facing surface 114, and spacer second axial surface 134 may mate with nut axial mating surface 112. Rotor 104, shaft 102, nut spacer 210*a*, and nut 108 may jointly comprise a balance arbor for balancing rotor 104. As will be evident to one skilled in the art, the outer diameter 124 of nut 108 may be piloted by rotor radially inward surface 115 of nut receiving portion 126 of rotor 104.

Figure 4B:
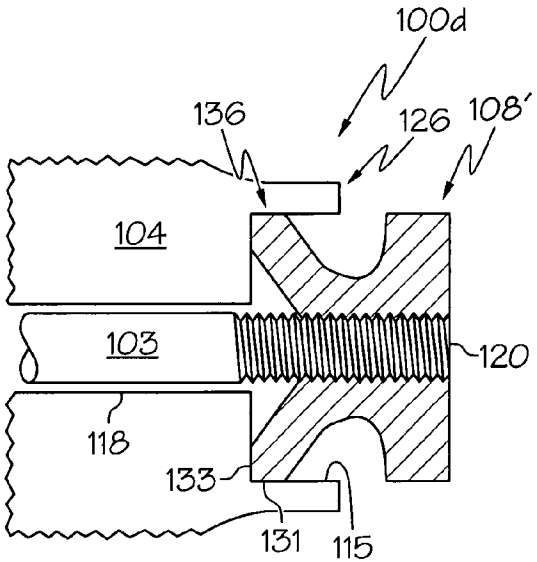
FIG. 4B is an axial sectional view of the rotor assembly of FIG. 4A.
Figure 4A:
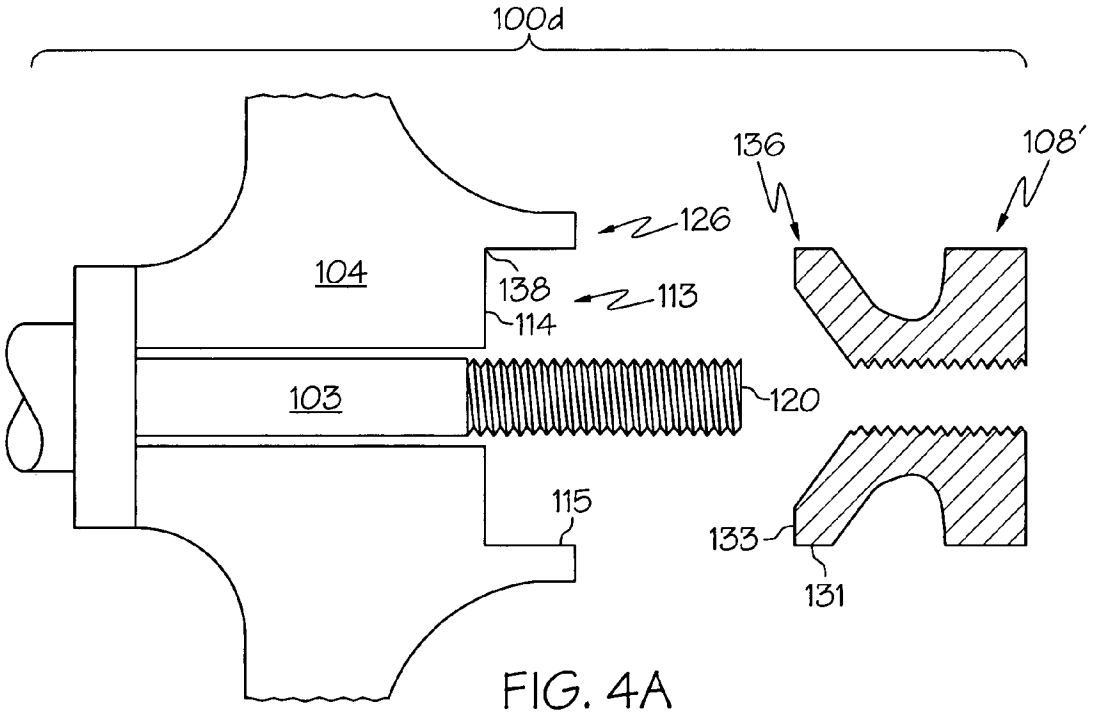
FIG. 4A is an exploded axial sectional view of a rotor assembly, according to another embodiment of the present invention.

FIG. 4A is an exploded sectional view of a nut end of a rotor assembly 100*d* having a braced nut 108', and FIG. 4B is a sectional view showing braced nut 108' mounted on shaft 102, according to another embodiment of the present invention. Rotor assembly 100*d* may include a rotor 104 having a nut-receiving portion 126 and a rotor axial face 114. Nut-receiving portion 126 may define a rotor radially inward surface 115.

Braced nut 108' may comprise a nut brace 136 for bracing braced nut 108' into a bracing corner 138 within annular recess 113 defined by nut-receiving portion 126 of rotor 104. Nut brace 136 may comprise a brace axial facing surface 133 and a brace radially outward surface 131. Bracing corner 138 may be disposed between rotor axial facing surface 114 and rotor radially inward surface 115. According to an alternative embodiment of the present invention (not shown in FIGS. 4A-B), braced nut 108' may be used in conjunction with a washer or nut spacer (see, for example, FIGS. 3C-D, 5A-B, 6A-B) for rotor assembly 100*d*. Brace radially outward surface 131 may mate with rotor radially inward surface 115, and brace axial facing surface 133 may mate with rotor axial facing surface 114.

Figure 5B:
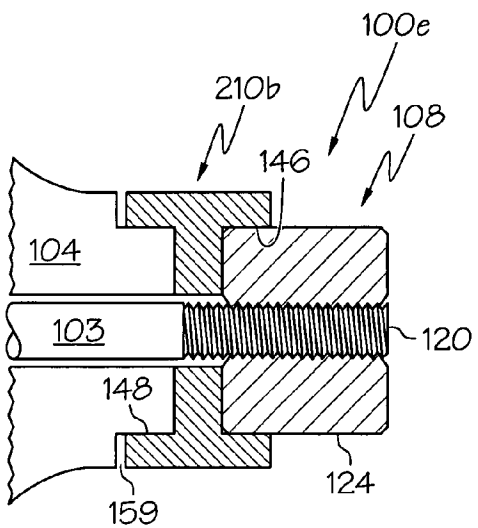
FIG. 5B is an axial sectional view of the rotor assembly of FIG. 5A.
Figure 5A:
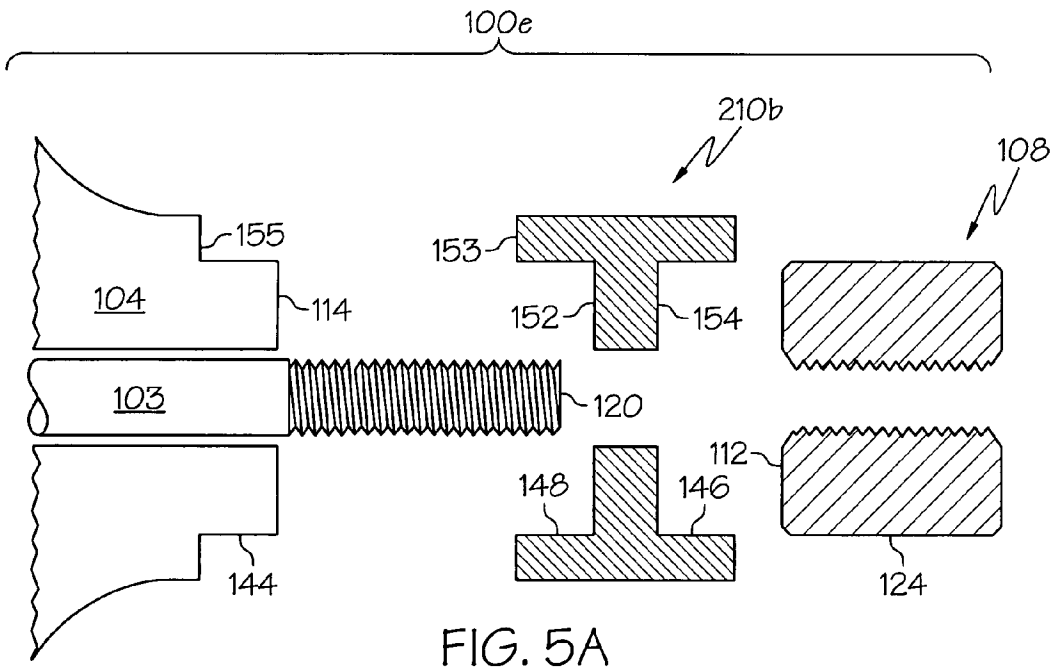
FIG. 5A is an exploded axial sectional view of a rotor assembly, according to another embodiment of the present invention.

FIG. 5A is an exploded sectional view of a nut end portion of a rotor assembly 100*e* having a nut spacer 210*b*, according to another embodiment of the present invention. Nut spacer 210*b* may serve as a nut piloting insert. Nut spacer 210*b* may be generally T-shaped in cross-section. FIG. 5B is a sectional view of rotor assembly 100*e* showing nut 108 mounted on shaft threaded portion 120, with nut spacer 210*b* disposed axially between rotor 104 and nut 108. Rotor 104 may include a rotor first axial surface 114, a rotor second axial surface 155, and a rotor radially outward surface 144.

With further reference to FIGS. 5A-B, nut spacer 210*b* may include a spacer first radially inward surface 148, a spacer second radially inward surface 146, a spacer first axial surface 152, a spacer second axial surface 154, and a spacer third axial surface 153. Spacer first axial surface 152 may mate with rotor first axial surface 114. Spacer second axial surface 154 may mate with a nut axial mating surface 112 of nut 108. Rotor radially outward surface 144 may mate with spacer first radially inward surface 148. Spacer second radially inward surface 146 may mate with nut outer diameter 124 to provide radial piloting of nut 108. As shown in FIG. 5B, an axial gap 159 may exist between spacer third axial surface 153 and rotor second axial surface 155.

Figure 6A:
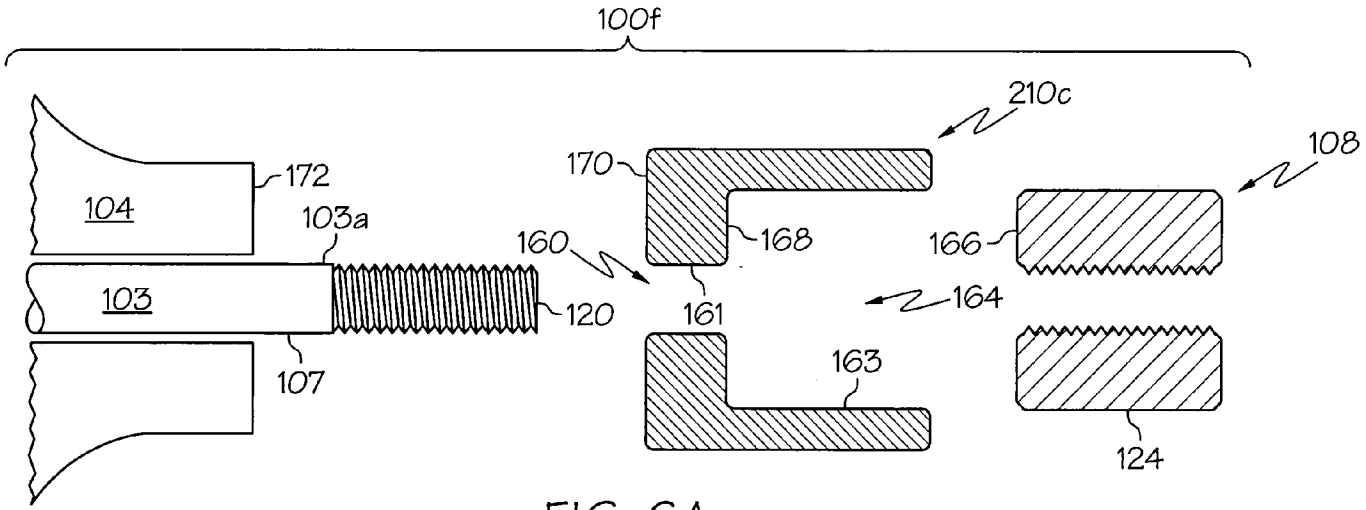
FIG. 6A is an exploded axial sectional view of a rotor assembly, according to another embodiment of the present invention.
Figure 6B:
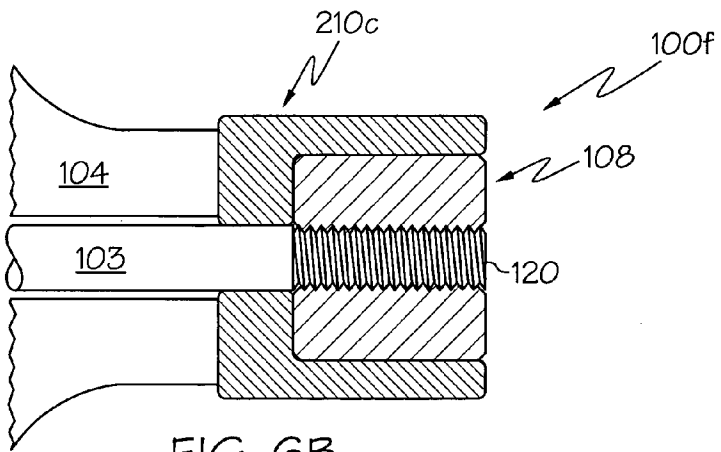
FIG. 6B is an axial sectional view of the rotor assembly of FIG. 6A.

FIG. 6A is an exploded sectional view of a nut end portion of a rotor assembly 100*f* according to another embodiment of the present invention. FIG. 6B is a sectional view of rotor assembly 100*f* of FIG. 6A showing a rotor 104 mounted on a shaft 102, a nut 108 threadably mounted on shaft threaded portion 120, and a nut spacer 210*c* disposed axially between rotor 104 and nut 108. Rotor 104 may include a rotor axial mating surface 172. Shaft 102 may include a smooth body portion 103 and a shaft threaded portion 120 extending proximally from smooth body portion 103. A proximal end 103*a* of smooth body portion 103 may extend axially beyond rotor axial mating surface 172 to define a shaft radially outward mating surface 107.

With further reference to FIGS. 6A-B, nut spacer 210*c* may be generally L-shaped in cross-section. Nut spacer 210*c* may include a spacer first axial surface 168 and a spacer second axial surface 170. Nut 108 may include a nut axial mating surface 166. Spacer first axial surface 168 may mate with nut axial mating surface 166 of nut 108. Spacer second axial surface 170 may mate with rotor axial mating surface 172.

Nut spacer 210*c* may further include a spacer first radially inward mating surface 161. Spacer first radially inward mating surface 161 may define a spacer first bore 160. Spacer first radially inward mating surface 161 may mate with shaft radially outward mating surface 107. Spacer first bore 160 may surround proximal portion 103*a* of shaft smooth body portion 103.

Nut spacer 210*c* may still further include a spacer second radially inward mating surface 163. Spacer second radially inward mating surface 163 may define a spacer second bore 164. Spacer second bore 164 may surround a nut outer diameter 124 of nut 108. Nut outer diameter 124 may define a radially outward mating surface of nut 108. Spacer second radially inward mating surface 163 may mate with nut outer diameter 124.

Figure 7A:
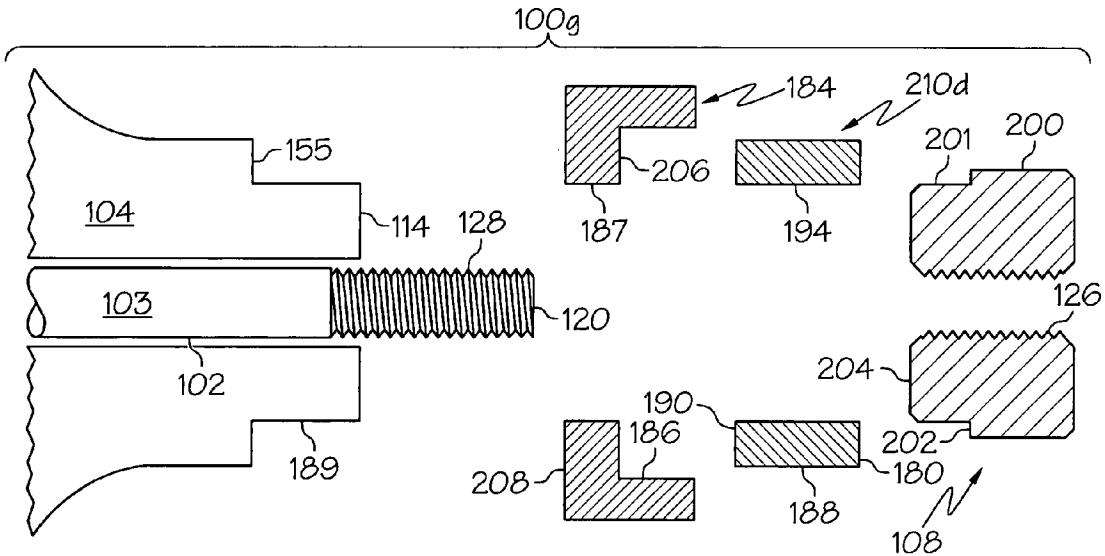
FIG. 7A is an exploded axial sectional view of a rotor assembly, according to another embodiment of the present invention.
Figure 7B:
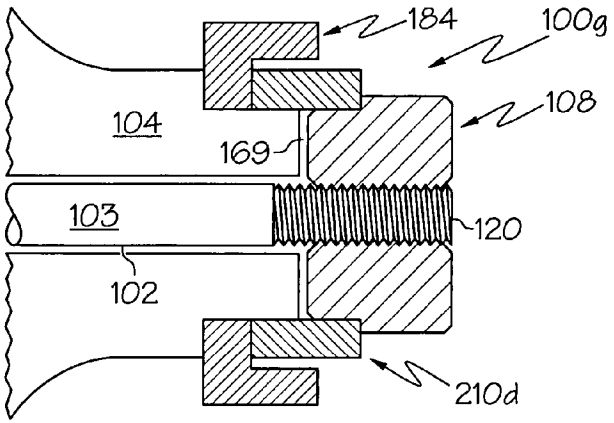
FIG. 7B is an axial sectional view of the rotor assembly of FIG. 7A.

With reference to FIGS. 7A-B, a rotor assembly 100*g*, according to another embodiment of the present invention, may comprise a rotor 104, a shaft 102 disposed within rotor 104, a nut 108 for threadable mounting on shaft 102, and a nut spacer 210*d*. Rotor 104 may include a rotor first axial mating surface 114, a rotor second axial mating surface 155, and a rotor radially outward mating surface 189.

Rotor assembly 100*g* may further include a spacer seat 184 axially disposed between rotor second axial mating surface 155 and nut spacer 210*d*. Spacer seat 184 may be part of a seal, thrust piston, or bearing, or may have other functional purposes within the rotor assembly. Spacer seat 184 may be generally L-shaped in cross-section. Nut 108 may include a nut first axial mating surface 202, and a nut second axial surface 204. Nut spacer 210*d* may include a spacer radially outward surface 188, a spacer radially inward mating surface 194, a spacer first axial surface 180, and a spacer second axial surface 190. Spacer seat 184 may include a seat first radially inward surface 186 and a seat second radially inward surface 187.

With further reference to FIGS. 7A-B, seat first radially inward surface 186 may surround spacer radially outward surface 188. A radial gap (not shown) may exist between first radially inward surface 186 and spacer radially outward surface 188. Rotor radially outward mating surface 189 may mate with both spacer radially inward mating surface 194 and seat second radially inward surface 187. Spacer radially inward mating surface 194 may further mate with a nut radially outward mating surface 201. A spacer first axial mating surface 180 of nut spacer 210*d* may mate with nut first axial mating surface 202. A spacer second axial mating surface 190 of nut spacer 210*d* may mate with a seat first axial mating surface 206 of spacer seat 184.

An axial gap 169 may exist between rotor first axial mating surface 114 and nut second axial surface 204 when nut 108 is secured to shaft 102 via mating nut threads 126 and shaft threads 128 of threaded portion 120. A seat second axial mating surface 208 may mate with rotor second axial mating surface 155. Nut 108 may have a nut outer diameter 200 which may be larger than the diameter of nut radially outward mating surface 201. For example, nut radially outward mating surface 201 may be recessed with respect to nut outer diameter 200.

Figure 8A:
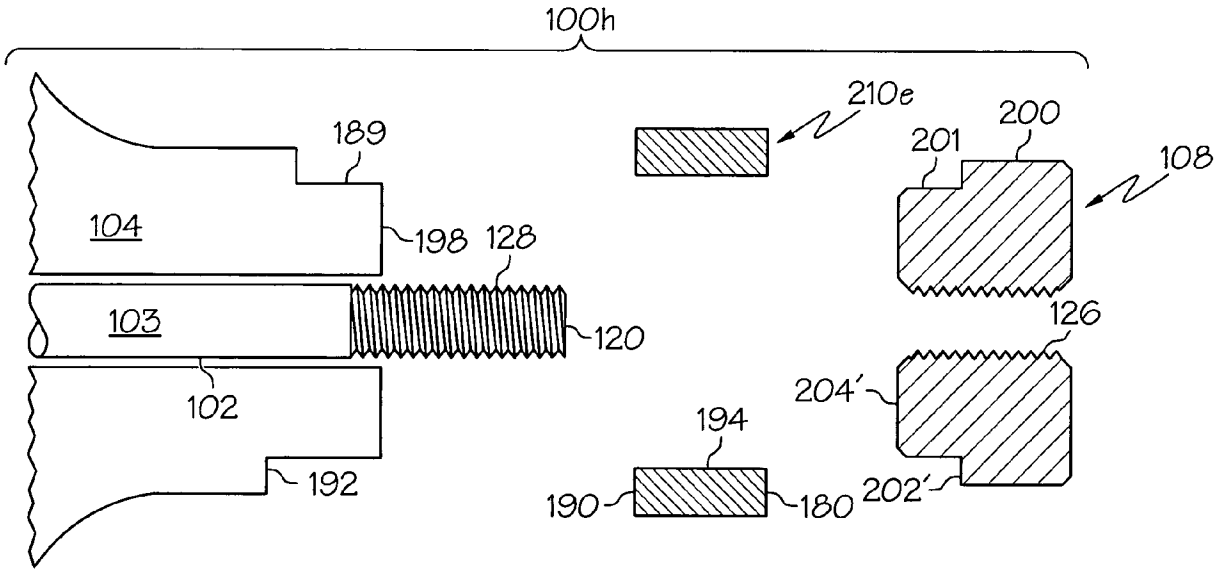
FIG. 8A is an exploded axial sectional view of a rotor assembly, according to another embodiment of the present invention.
Figure 8B:
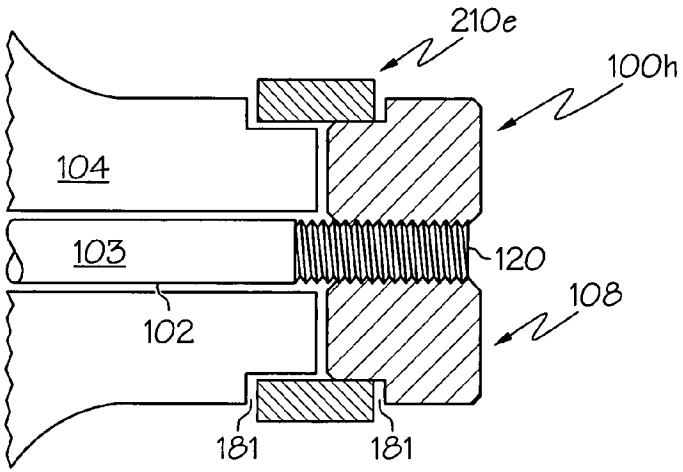
FIG. 8B is an axial sectional view of the rotor assembly of FIG. 8A.

With reference to FIGS. 8A-B, a rotor assembly 100*h*, piloting on a nut spacer 210*e*, according to another embodiment of the present invention, may comprise a rotor 104, a nut 108, and an axially floating nut spacer 210*e*, wherein nut 108 may be substantially L-shaped in cross-section. Rotor 104 may include a rotor axial facing surface 192, a rotor axial mating surface 198, and a rotor radially outward mating surface 189.

With further reference to FIGS. 8A-B, nut 108 may include a nut first radially outward surface (or nut outer diameter) 200, a nut radially outward mating surface 201, a nut axial facing surface 202', and a nut axial mating surface 204'. Nut radially outward mating surface 201 may be a recessed surface. Rotor axial mating surface 198 may mate with nut axial mating surface 204. Axially floating nut spacer 210*e* may include a spacer radially inward mating surface 194, a spacer first axial surface 180, and a spacer second axial surface 190.

Spacer radially inward mating surface 194 may mate with rotor radially outward mating surface 189. Spacer radially inward mating surface 194 may further mate with nut radially outward mating surface 201. Rotor axial mating surface 198 may mate with nut axial mating surface 204' when nut 108 is secured to shaft 102 via nut threads 126 mating with shaft threads 128 of threaded portion 120.

When axially floating nut spacer 210*e* and nut 108 are mounted on shaft threaded portion 120, rotor axial facing surface 192 may face spacer second axial surface 190, while spacer first axial surface 180 may face nut axial facing surface 202'. An axial gap 181 may exist between rotor axial facing surface 192 and spacer second axial surface 190, or between spacer first axial surface 180 and nut axial facing surface 202'. For clarity of illustration, an axial gap is shown in FIG. 8B between both rotor axial facing surface 192 and spacer second axial surface 190, and between spacer first axial surface 180 and nut axial facing surface 202'.

Axially floating nut spacer 210*e* may contact rotor 104 or nut 108, at the interface of either rotor axial facing surface 192 and spacer second axial surface 190, or at spacer first axial surface 180 and nut axial facing surface 202'; but axially floating nut spacer 210*e* typically may not contact both rotor 104 and nut 108.

Figure 9A:
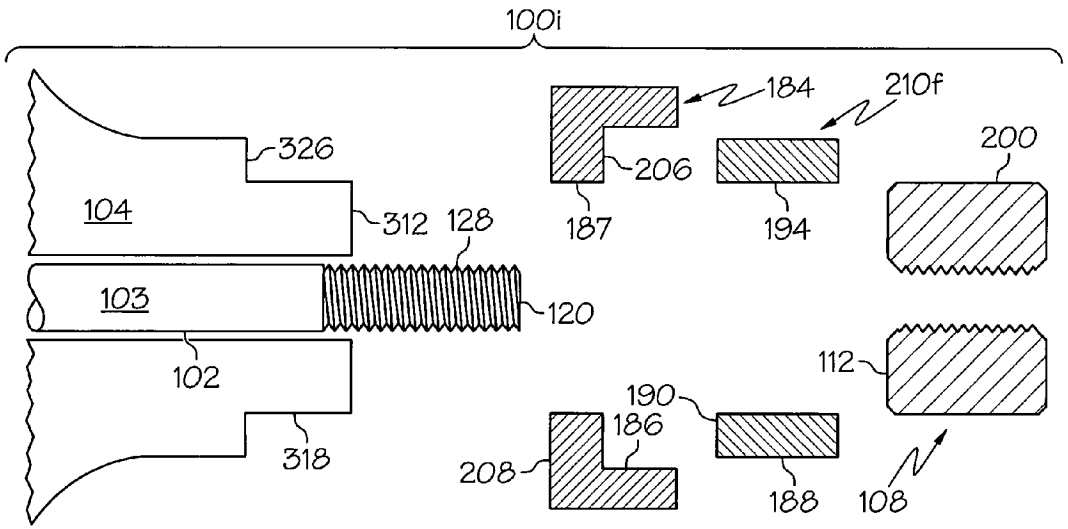
FIG. 9A is an exploded axial sectional view of a rotor assembly, according to a further embodiment of the present invention.
Figure 9B:
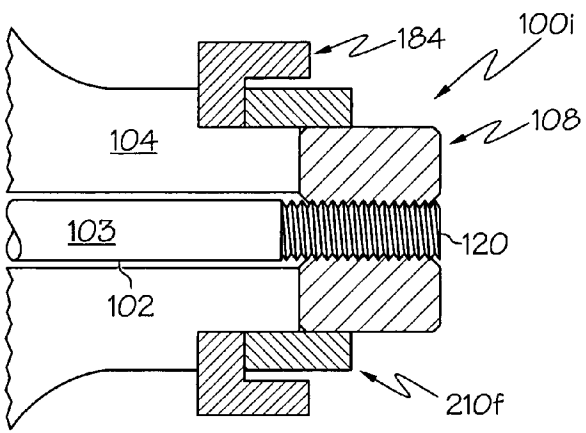
FIG. 9B is an axial sectional view of the rotor assembly of FIG. 9A.

With reference to FIGS. 9A-B, a rotor assembly 100*i* according to another embodiment of the present invention may comprise a rotor 104 piloting on a nut spacer 210*f*, a spacer seat 184, and a nut 108. Nut spacer 210*f* may be disposed radially outward from nut 108. Nut spacer 210*f* may include a spacer radially outward surface 188. Spacer seat 184 may include a seat first radially inward surface 186. Nut 108 may include a nut axial mating surface 112 and a nut outer diameter 200. Seat first radially inward surface 186 may mate, or form a gap, with spacer radially outward surface 188. A rotor first axial mating surface 312 of rotor 104 may mate with nut axial mating surface 112. Nut spacer 210*f* may pilot nut outer diameter 200 along a radially inward spacer piloting surface 194 of nut spacer 210*f*. Nut spacer 210*f* may further include a spacer axial mating surface 190.

With further reference to FIGS. 9A-B, spacer piloting surface 194 of nut spacer 210*f* may mate with a radially outward rotor piloting surface 318 of rotor 104. Spacer axial mating surface 190 may mate with a seat first axial mating surface 206 of spacer seat 184. A seat second axial mating surface 208 of spacer seat 184 may mate with a rotor second axial mating surface 326 of rotor 104. A seat second radially inward surface 187 of spacer seat 184 may mate with a rotor radially outward surface 318 of rotor 104. Optionally, nut spacer 210*f* may be removed from rotor assembly 100*i* after nut 108 is secured to shaft threaded portion 120. Optionally, spacer seat 184 may be removed with nut spacer 210*f*.

Figure 10A:
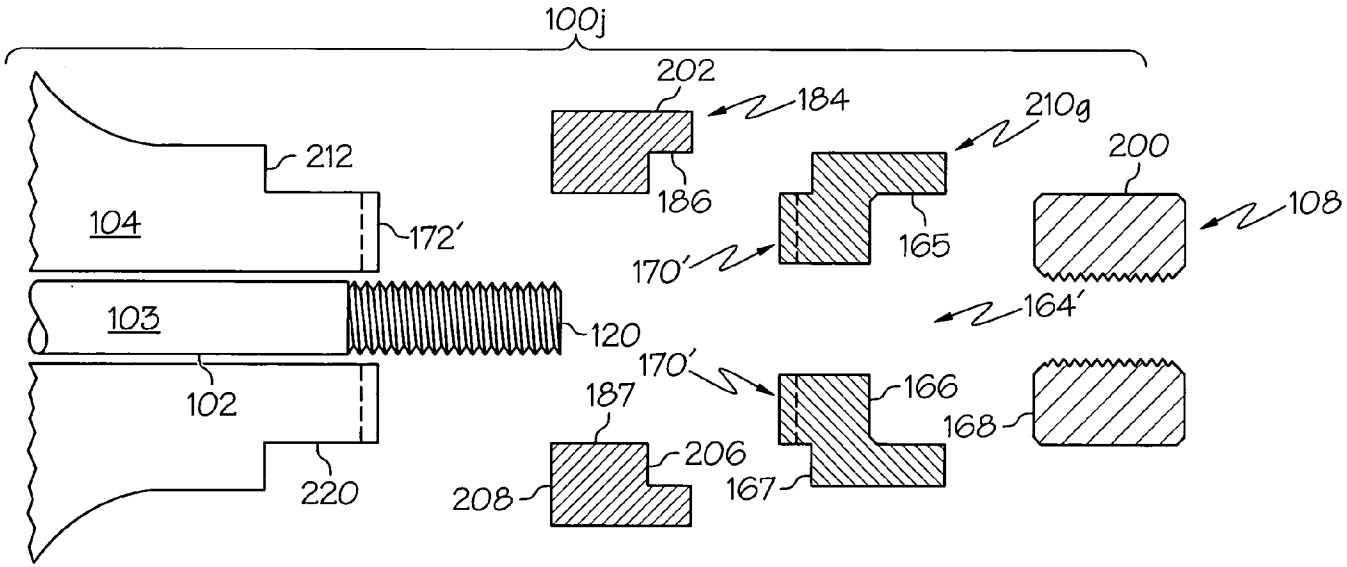
FIG. 10A is an exploded axial sectional view of a rotor assembly, according to a still further embodiment of the present invention.
Figure 10B:
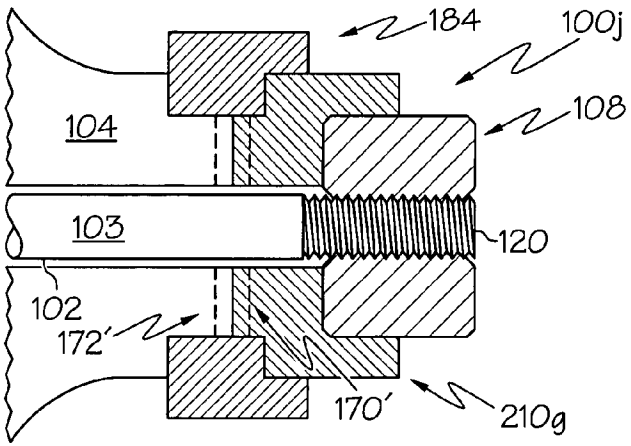
FIG. 10B is an axial sectional view of the rotor assembly of FIG. 10A.

FIG. 10A is an exploded sectional view of a nut end portion of a rotor assembly 100*j*, and FIG. 10B is a sectional view of rotor assembly 100*j* of FIG. 10A, according to another embodiment of the present invention. Rotor assembly 100*j* may comprise a rotor 104, a spacer seat 184, a nut spacer 210*g*, and a nut 108. Rotor 104 having a rotor axial portion 172', a rotor axial surface 212, and a rotor radially outward surface 220.

Nut spacer 210*g* may include a spacer axial portion 170', a spacer radially inward surface 165, and a spacer first axial surface 166. Rotor axial portion 172' may mate with spacer axial portion 170'. Spacer axial portion 170' may comprise a spacer axial and radial piloting feature compatible with rotor axial portion 172.' Rotor axial portion 172' may comprise a curvic coupling, a rabbit coupling, a radial spline, or other suitable rotor piloting feature well known in the art that may provide both radial and axial piloting features. Spacer first axial surface 166 may mate with a nut axial mating surface 168 of nut 108. Spacer radially inward surface 165 may define a spacer bore 164' of nut spacer 210*g*. Spacer radially inward surface 165 may surround, and mate with, a nut outer diameter 200 of nut 108.

With further reference to FIGS. 10A-B, spacer seat 184 may include a seat first radially inward surface 186, a seat radially outward surface 202, a seat first axial surface 206 and a seat second axial surface 208. Seat first radially inward surface 186 may surround rotor axial portion 172' and spacer axial portion 170'. Spacer seat 184 may be disposed axially between nut spacer 210*g* and rotor 104. Spacer seat 184 may be disposed between, and contained by, rotor axial surface 212 and spacer second axial surface 167. Spacer seat 184 may also include functional features unrelated to outside diameter nut piloting, but which may be critical to other aspects of turbomachinery function.

Figure 11:
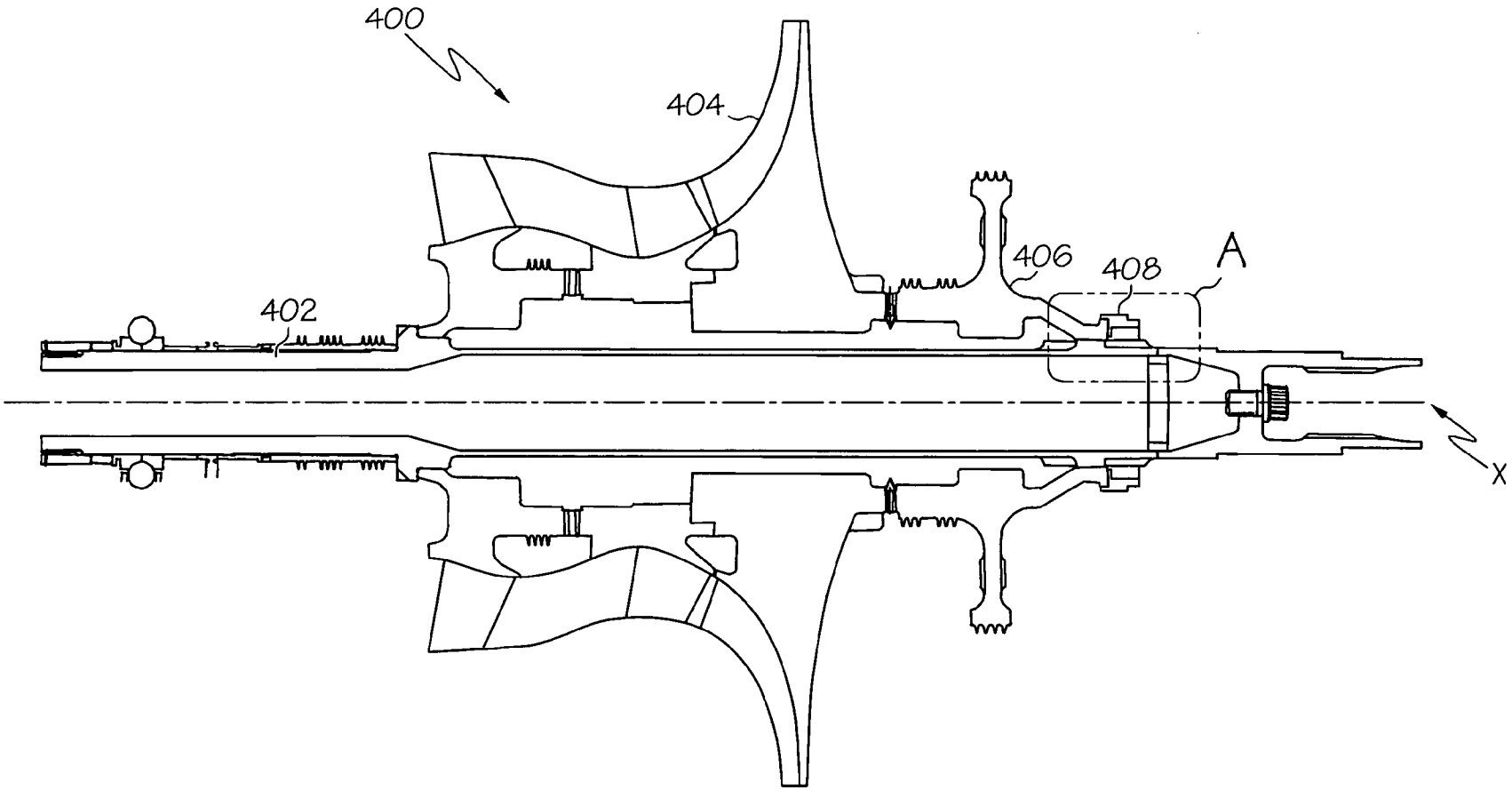
FIG. 11 is an axial sectional view of a component stack, according to another embodiment of the present invention.

Referring to FIG. 11, a rotating component stack 400 for a turbine system may comprise a rotor stack 404, a thrust piston 406, and a nut 408. Each of the rotor stack 404, thrust piston 406, and nut 408 may have a common axis X, and may be secured in fixed relation to each other. Thrust piston 406 may be disposed between rotor stack 404 and nut 408. Rotor stack 404 may comprise a plurality of rotating components supported on a tie-shaft 402. Tie-shaft 402 may have a tie-shaft yield strength and may be preloaded in tension to a predetermined percentage of the tie-shaft yield strength.

Figure 12:
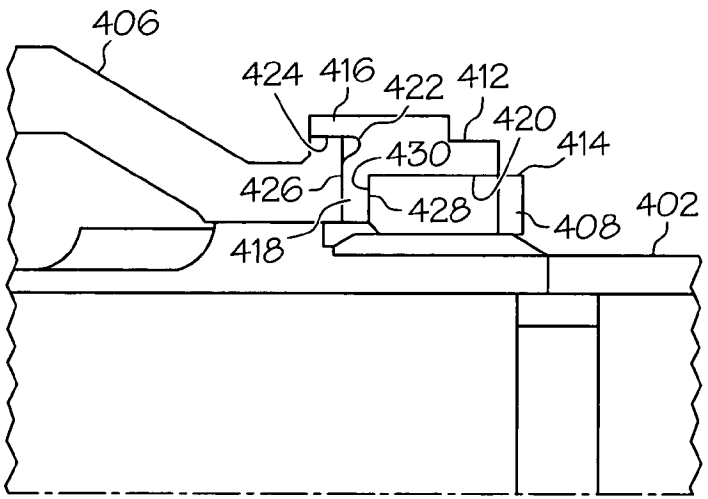
FIG. 12 is an expanded view of Area A of the component stack of FIG. 11.

As shown in FIG. 12, which is an enlarged view of area A of FIG. 11, a nut piloting insert, such as a nut spacer 412, may be disposed axially between thrust piston 406 and nut 408. Nut spacer 412 may be used for piloting the outer diameter of nut 408. At least a portion of the plurality of rotating components of rotor stack 404 may be axially constrained by tie-shaft 402, nut spacer 412, and nut 408.

Figure 13:
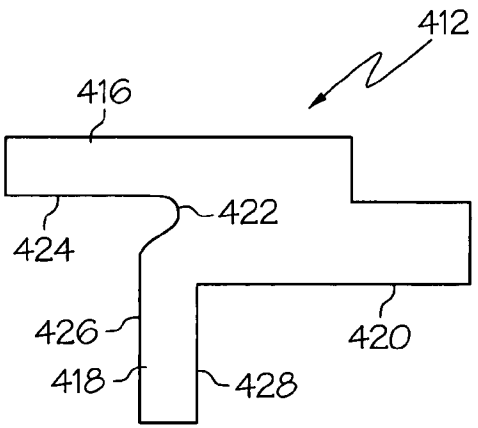
FIG. 13 is an expanded view of a nut piloting insert of the component stack of FIG. 12.

As seen in FIG. 13, nut spacer 412 may comprise a first arm 416, a second arm 418, and a spacer nut-mating surface 420. A curved portion 422 of nut spacer 412 may be disposed between first arm 416 and second arm 418. Nut spacer 412 may also comprise a first arm mating surface 424, a second arm external mating surface 426, and a second arm internal mating surface 428. Spacer nut-mating surface 420 may mate with a nut insert-mating surface 414 of nut 408. Nut insert-mating surface 414 may define the outer diameter of nut 408. Second arm internal mating surface 428 may mate with a nut axial mating surface 430 of nut 408. First arm mating surface 424 and second arm external mating surface 426 may each mate with a foot 410 of thrust piston 406 (see, FIG. 12).

Figure 14:
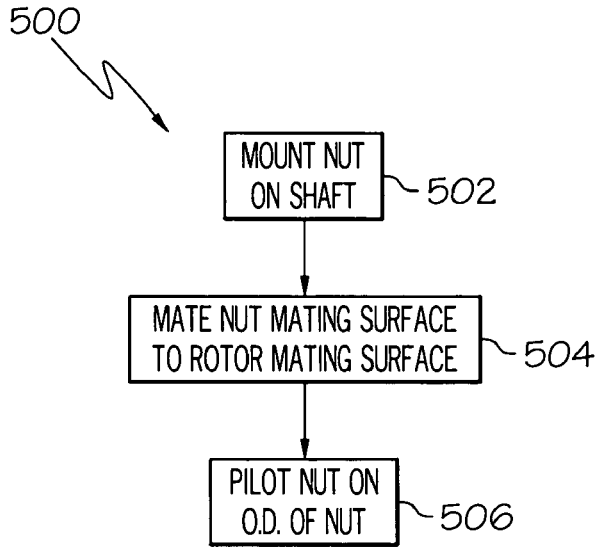
FIG. 14 is a flow chart of a method for piloting a nut on the outer diameter of the nut, according to another embodiment of the present invention.

With reference to FIG. 14, a method 500 for radial piloting of a nut outer diameter to prevent shaft bow may comprise a step 502 of mounting a nut on a shaft supporting a rotor. The nut may include a nut mating portion having at least one nut mating surface, and the rotor may include a rotor mating portion having at least one rotor mating surface. The rotor mating portion may surround the nut mating portion.

Thereafter, a step 504 may comprise mating the nut mating portion of the nut to the rotor mating portion of the rotor. Step 504 may involve mating at least one nut mating surface to at least one rotor mating surface. The at least one rotor mating surface may include a rotor radially inward surface, which may surround the nut outer diameter. The at least one nut mating surface may comprise an axial surface of the nut. The at least one rotor mating surface may comprise both a rotor radially inward surface and a rotor axially facing surface. The rotor radially inward surface may be disposed radially outward from the nut outer diameter. The rotor radially inward surface may surround the nut outer diameter. An axial load may exist between the nut axial facing surface and the rotor axial facing surface.

Method 500 may further include a step 506 of piloting the nut on the outer diameter of the nut. The rotor supported on the shaft may comprise a stack of rotary components. Tightening the nut onto the shaft may reduce non-uniform loading of the stack of rotary components on the shaft.

Figure 15:
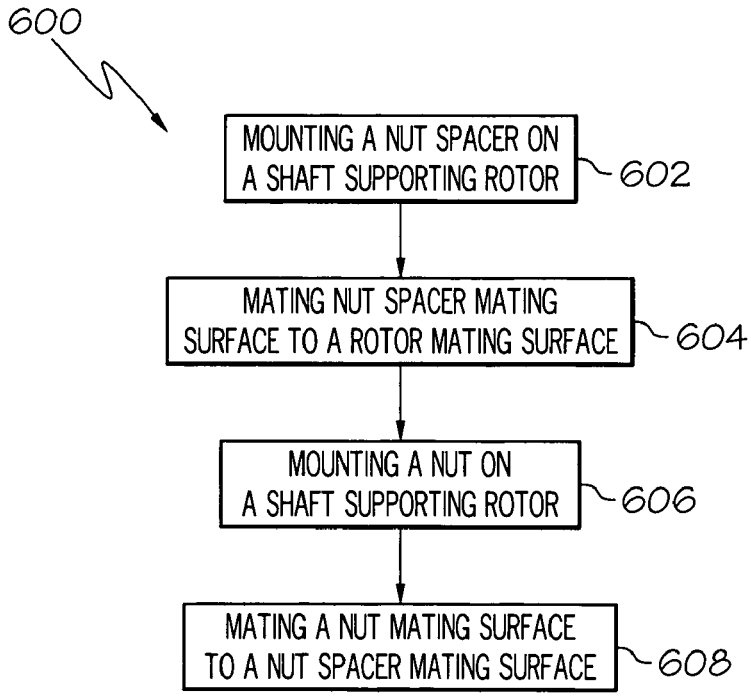
FIG. 15 is a flow chart of a method for reducing shaft bow, according to another embodiment of the present invention.

In FIG. 15, a method 600 for radial piloting of a nut outer diameter with a nut spacer may comprise a step 602 of mounting a nut spacer on a shaft supporting a rotor. In step 604, the nut spacer may be mated with at least one rotor mating surface. Then the nut, in step 606, may be mounted on the shaft supporting the rotor. The nut may then be mated with the nut spacer in step 608.

It should be understood, of course, that the foregoing relates to exemplary embodiments of the invention and that modifications may be made without departing from the spirit and scope of the invention as set forth in the following claims.

We claim:

1. A rotor assembly, comprising:

a rotor;

a shaft coaxial with the rotor; and a nut for axially loading the rotor and the shaft, wherein:

the rotor includes a rotor axial facing surface and a rotor radially inward surface, the rotor includes a nut-receiving portion defining an annular recess within the rotor, the annular recess is bounded by the rotor axial facing surface and the rotor radially inward surface, the nut comprises a braced nut including a nut brace for bracing the braced nut into a nut bracing corner within the nut-receiving portion of the rotor, the nut bracing corner is disposed within the nut-receiving portion at the rotor axial facing surface, the nut includes a nut axial facing surface, the nut has a radially outward surface, and radial piloting of the nut to the rotor occurs between the rotor radially inward surface and the nut radially outward surface.

2. The rotor assembly of claim 1, farther comprising a nut spacer disposed axially between the rotor axial facing surface and the nut axial facing surface.

3. The rotor assembly of claim 1, wherein the nut comprises a steel alloy, a nickel-base alloy, a cobalt-base alloy, an aluminum alloy, or a titanium alloy.

4. The rotor assembly of claim 1, wherein an axial load exists between a rotor axial mating surface of the rotor and a nut axial mating surface of the nut.

5. The rotor assembly of claim 1, wherein the rotor radially inward surface surrounds a nut outer diameter.

6. The rotor assembly of claim 1, wherein the rotor radially inward surface mates with a nut outer diameter.

7. The rotor assembly of claim 1, wherein the shaft includes a shaft threaded portion for receiving the nut.

8. A rotor assembly, comprising:
a tie-shaft;
a rotor co-axial with the tie-shaft;
a nut for axially loading the rotor and the tie-shaft; and
a nut spacer disposed on at least one of the rotor and the tie-shaft, wherein
the tie-shaft has a yield strength, and the tie-shaft is preloaded in tension to a predetermined percentage of the yield strength,
the rotor includes a rotor first axial mating surface,
the tie-shaft includes a tie-shaft radially outward mating surface,
the nut spacer includes a spacer first axial mating surface, a spacer second axial mating surface, and a spacer first radially inward mating surface,
the tie-shaft radially outward mating surface extends axially beyond the rotor axial mating surface,
the spacer first radially inward mating surface mates with the tie-shaft radially outward mating surface;
the spacer first axial mating surface mates with a nut axial mating surface of the nut,
the nut spacer is axially disposed between the rotor and the nut,
the nut spacer includes a first arm, a second arm, and a spacer nut-mating surface,
the spacer nut-mating surface mates with a nut spacer-mating surface of the nut, and
an internal mating surface of the second arm mates with an outer diameter of the nut.

9. The rotor assembly of claim 8, wherein:
the spacer second axial mating surface mates with the rotor axial mating surface.

10. The rotor assembly of claim 8, wherein:
the rotor includes a rotor second axial mating surface and a rotor radially outward mating surface,
the rotor assembly further comprises a spacer seat axially disposed between the rotor second axial mating surface and the nut spacer,
the spacer seat includes a seat first axial mating surface, a seat first radially inward surface, and a seat second radially inward surface,
the rotor radially outward mating surface mates with both the spacer first radially inward mating surface and the seat second radially inward surface,
the spacer first radially inward mating surface mates with a nut radially outward mating surface of the nut, and
the spacer second axial mating surface mates with the seat first axial mating surface.

11. The rotor assembly of claim 8, wherein:
the rotor includes a rotor axial facing surface and a rotor radially outward mating surface,
the nut includes a nut first radially outward surface, a nut radially outward mating surface, a nut axial facing surface, and the nut axial mating surface,
the rotor first axial mating surface mates with the nut axial mating surface,
the nut spacer comprises an axially floating nut spacer including the spacer first radially inward mating surface, the spacer first axial mating surface, and the spacer second axial mating surface,
the spacer first radially inward mating surface mates with the rotor radially outward mating surface,
the spacer first radially inward mating surface further mates with the nut radially outward mating surface,
the rotor axial facing surface faces the spacer second axial mating surface,
the spacer first axial mating surface faces the nut axial facing surface, and
an axial gap exists between the rotor axial facing surface and the spacer second axial mating surface, or between the spacer first axial mating surface and the nut axial facing surface.

12. The rotor assembly of claim 8, wherein:
the rotor is piloted on the nut spacer, the nut, and a spacer seat,
the rotor includes a rotor second axial mating surface, and a rotor radially outward surface,
the nut spacer is disposed radially outward from the nut,
the spacer seat includes a seat first radially inward surface, a seat second radially inward surface, and a seat second axial mating surface,
the nut includes the nut axial mating surface and a nut outer diameter,
the seat first radially inward surface mates with a spacer radially outward surface of the nut spacer,
the nut axial mating surface mates with the rotor first axial mating surface,
the nut spacer includes a radially inward spacer piloting surface,
the nut spacer pilots the nut outer diameter along the radially inward spacer piloting surface,
the spacer second axial mating surface mates with a seat first axial mating surface of the spacer seat,
the seat second axial mating surface mates with the rotor second axial mating surface, and
the seat second radially inward surface mates with the rotor radially outward surface.

13. A rotating component stack for a turbine system, comprising:
a rotor stack having a shaft receiving bore axially defined therein;
a tie-shaft disposed within the shaft-receiving bore;
a nut for axially loading the rotor stack and the tie-shaft; and
a nut spacer disposed on at least one of the rotor and the tie-shaft, the nut spacer having a T-shaped cross-sectional shape or an L-shaped cross-sectional shape, wherein:
the rotor stack comprises a plurality of components,
each of the plurality of components of the rotor stack and the nut having a common axis,
each of the plurality of components of the rotor stack and the nut being secured in fixed relation to each other,
the nut having a nut mating surface and a nut axial facing surface,
the nut is piloted on an outer diameter of the nut,
the rotor stack includes a rotor radially inward surface and a rotor axial facing surface,
the rotor axial facing surface and the nut mating surface are perpendicular to the tie-shaft axis.

14. The rotating component stack of claim 13, wherein an axial load exists between the rotor axial facing surface and the nut axial facing surface.

15. The rotating component stack of claim 13, wherein the nut spacer is disposed between the rotor and the nut.

16. The rotating component stack of claim 13, wherein the tie-shaft includes a threaded portion for mounting the nut thereon.

17. The rotating component stack of claim 13, further comprising a thrust piston disposed between the rotor stack and the nut.

18. The rotating component stack of claim 13, wherein the nut spacer comprises a washer.

19. The rotating component stack of claim 13, wherein each of the nut and the nut spacer comprises a nickel-base superalloy, a cobalt-base superalloy, a titanium alloy, an aluminum alloy or an iron based alloy.

20. The rotating component stack of claim 13, wherein:

the rotor stack includes a rotor axial portion comprising a rotor axial and radial piloting feature, the nut spacer includes a spacer axial portion comprising a spacer axial and radial piloting feature that mates to the rotor stack, and the rotor axial and radial piloting feature comprises a curvic coupling, a rabbit coupling, or a radial spline.

21. The rotor assembly of claim 1, wherein the shaft has a yield strength, and the shaft is preloaded in tension to a predetermined percentage of the yield strength.

22. The rotating component stack of claim 13, wherein the tie-shaft has a yield strength, and the tie-shaft is preloaded in tension to a predetermined percentage of the yield strength.

* * * * *